US011441760B2

(12) United States Patent
Roys et al.

(10) Patent No.: US 11,441,760 B2
(45) **Date of Patent: *Sep. 13, 2022**

(54) SYSTEM AND METHOD FOR MOUNTING LED LIGHT MODULES

(71) Applicants: Curtis Alan Roys, Fredericksburg, TX (US); Sidney Howard Norton, Odessa, TX (US)

(72) Inventors: Curtis Alan Roys, Fredericksburg, TX (US); Sidney Howard Norton, Odessa, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/329,006

(22) Filed: May 24, 2021

(65) Prior Publication Data

US 2021/0388974 A1 Dec. 16, 2021

Related U.S. Application Data

(60) Continuation of application No. 16/366,888, filed on Mar. 27, 2019, now Pat. No. 11,022,282, which is a (Continued)

(51) Int. Cl.
*F21V 21/088* (2006.01)
*F21V 19/00* (2006.01)
(Continued)

(52) U.S. Cl.
CPC ..... *F21V 21/088* (2013.01); *F21V 19/004* (2013.01); *F21V 21/005* (2013.01);
(Continued)

(58) Field of Classification Search
CPC .. F21V 21/088; F21V 21/005; F21V 21/0885; F21V 21/34; F21V 19/004;
(Continued)

(56) References Cited

U.S. PATENT DOCUMENTS 799,065 A 9/1905 Kronstein
3,883,926 A 5/1975 Reynolds
(Continued)

FOREIGN PATENT DOCUMENTS

DE 29616093 U1 10/1996
DE 202012102037 U1 7/2012
EP 1931006 A1 6/2008

OTHER PUBLICATIONS

U.S. Appl. No. 29/639,296, filed Mar. 5, 2018, Curtis Alan Roys.
(Continued)

*Primary Examiner* — Jong-Suk (James) Lee
*Assistant Examiner* — James M Endo
(74) *Attorney, Agent, or Firm* — Scheinberg & Associates, PC

(57) ABSTRACT

An LED support clip enables mounting of light-emitting diode (LED) modules onto support elements which may be pre-existing, such as tubing, while avoiding problems with current mounting methods. One or more LED light modules may be clamped into the LED support clip without the need for adhesives or screws, thereby forming an LED light assembly. One or more LED light assemblies may be clamped onto the support element. The LED support clip may comprise multiple clamps configured with spring tension jaws designed into the manufacturing process of the LED support clip. Support elements may be oriented horizontally, vertically or at various angles and may have a variety of cross-sectional shapes, including: square, triangular, rectangular, pentagonal, hexagonal, "I"-shaped, "L"-shaped, and round, over a wide cross-sectional dimension range.

20 Claims, 11 Drawing Sheets

Related U.S. Application Data continuation-in-part of application No. 16/282,039, filed on Feb. 21, 2019, now abandoned, said application No. 16/366,888 is a division of application No. 29/657,390, filed on Jul. 20, 2018, now Pat. No. Des. 882,160, and a division of application No. 29/639,296, filed on Mar. 5, 2018, now Pat. No. Des. 890,983.

(60) Provisional application No. 62/635,362, filed on Feb. 26, 2018.

(51) Int. Cl.

| | |
|---|---|
| ***F21V 21/005*** | (2006.01) |
| ***F21V 23/00*** | (2015.01) |
| ***F21Y 115/10*** | (2016.01) |
| ***F21S 4/28*** | (2016.01) |
| ***F21S 4/20*** | (2016.01) |

(52) U.S. Cl.

CPC ..... *F21V 23/001* (2013.01); *F21S 4/20* (2016.01); *F21S 4/28* (2016.01); *F21Y 2115/10* (2016.08)

(58) Field of Classification Search

CPC .... F21V 17/162; F21V 17/166; F21V 17/168; F21S 4/28; F21S 4/22; F21S 4/24; F21S 4/26

See application file for complete search history.

(56) References Cited

U.S. PATENT DOCUMENTS

| | | | | |
|---|---|---|---|---|
| 3,894,225 | A | 7/1975 | Chao | |
| 4,023,758 | A | 5/1977 | Yuda | |
| 4,173,035 | A | 10/1979 | Hoyt | |
| 4,439,818 | A | 3/1984 | Scheib | |
| 5,288,047 | A | 2/1994 | Pan | |
| 5,331,512 | A | 7/1994 | Orton | |
| 5,559,681 | A | 9/1996 | Duarte | |
| 5,707,136 | A | 1/1998 | Byers | |
| 6,056,418 | A | 5/2000 | Hsu | |
| 6,109,765 | A | 8/2000 | Blanton | |
| 6,216,987 | B1 | 4/2001 | Fukuo | |
| 6,267,342 | B1 | 7/2001 | Huang | |
| 6,685,385 | B1 | 2/2004 | Ledingham | |
| 7,213,941 | B2 | 5/2007 | Sloan et al. | |
| 7,478,924 | B2 | 1/2009 | Robertson | |
| 7,744,266 | B2 | 6/2010 | Higley et al. | |
| 7,784,745 | B2 | 8/2010 | Dodge | |
| D623,342 | S | 9/2010 | Kluś | |
| D623,343 | S | 9/2010 | Klus | |
| D625,588 | S | 10/2010 | Norris et al. | |
| D649,681 | S | 11/2011 | Trzesniowski | |
| D649,682 | S | 11/2011 | Trzesniowski | |
| D649,683 | S | 11/2011 | Trzesniowski | |
| D649,692 | S | 11/2011 | Trzesniowski | |
| D652,568 | S | 1/2012 | Trzesniowski | |
| D652,985 | S | 1/2012 | Trzesniowski | |
| D652,986 | S | 1/2012 | Trzesniowski | |
| D662,653 | S | 6/2012 | Hochman | |
| D663,048 | S | 7/2012 | Chen | |
| D665,518 | S | 8/2012 | Takahashi et al. | |
| D666,328 | S | 8/2012 | Morton | |
| 8,240,894 | B2 | 8/2012 | Sanroma et al. | |
| D673,307 | S | 12/2012 | Moghal | |
| 8,449,145 | B1 * | 5/2013 | Berry | F21S 4/00 362/249.02 |
| 8,474,998 | B2 | 7/2013 | Wang et al. | |
| D695,955 | S | 12/2013 | Klus | |
| D715,461 | S | 10/2014 | Chen | |
| D724,257 | S | 3/2015 | Klus | |
| D724,259 | S | 3/2015 | Klus | |
| D724,260 | S | 3/2015 | Klus | |
| D775,409 | S | 12/2016 | Klus | |
| D775,410 | S | 12/2016 | Klus | |
| D782,104 | S | 3/2017 | Klus | |
| D792,017 | S | 7/2017 | Klus | |
| D796,110 | S | 8/2017 | Klus | |
| D798,471 | S | 9/2017 | Tremaine et al. | |
| D799,065 | S | 10/2017 | Tremaine et al. | |
| D802,176 | S | 11/2017 | Tan et al. | |
| D807,572 | S | 1/2018 | Klus | |
| D809,704 | S | 2/2018 | Klus | |
| D818,187 | S | 5/2018 | Trzesniowski | |
| D818,188 | S | 5/2018 | Trzesniowski | |
| D818,189 | S | 5/2018 | Trzesniowski | |
| D818,194 | S | 5/2018 | Trzesniowski | |
| D818,633 | S | 5/2018 | Barker et al. | |
| D831,465 | S | 10/2018 | MacDonald et al. | |
| D834,398 | S | 11/2018 | MacDonald et al. | |
| D834,399 | S | 11/2018 | MacDonald et al. | |
| D845,516 | S | 4/2019 | Yuan | |
| D847,412 | S | 4/2019 | Trzcieliński | |
| D868,353 | S | 11/2019 | Trzcielinski | |
| D868,355 | S | 11/2019 | Trzcielinski | |
| 10,488,020 | B2 | 11/2019 | Zanotto et al. | |
| D869,070 | S | 12/2019 | Trzcieliński | |
| D869,071 | S | 12/2019 | Trzcieliński | |
| D869,072 | S | 12/2019 | Trzcielinski | |
| D869,073 | S | 12/2019 | Trzcielinski | |
| D869,074 | S | 12/2019 | Trzcielinski | |
| D869,077 | S | 12/2019 | Trzcielinski | |
| D869,078 | S | 12/2019 | Trzcieliński | |
| D869,080 | S | 12/2019 | Trzcieliski | |
| D869,081 | S | 12/2019 | Trzcielinski | |
| D872,931 | S | 1/2020 | Tremaine et al. | |
| D876,001 | S | 2/2020 | Sugiyama et al. | |
| D876,714 | S | 2/2020 | Klus | |
| D877,402 | S | 3/2020 | Klus | |
| D882,160 | S | 4/2020 | Roys et al. | |
| D887,033 | S | 6/2020 | Roys et al. | |
| D890,983 | S | 7/2020 | Roys et al. | |
| D891,688 | S | 7/2020 | Tremaine et al. | |
| D904,675 | S | 12/2020 | Trzcielinski | |
| D906,548 | S | 12/2020 | Jackson et al. | |
| D906,581 | S | 12/2020 | Trzcieliński | |
| 2006/0039142 | A1 | 2/2006 | Temple | |
| 2007/0242466 | A1 | 10/2007 | Wu | |
| 2008/0158858 | A1 | 7/2008 | Madireddi et al. | |
| 2009/0121988 | A1 | 5/2009 | Amo et al. | |
| 2009/0146910 | A1 | 6/2009 | Gardner | |
| 2009/0296381 | A1 | 12/2009 | Dubord | |
| 2011/0019413 | A1 | 1/2011 | Zimmerman et al. | |
| 2011/0058377 | A1 | 3/2011 | Chou et al. | |
| 2011/0058357 | A1 | 4/2011 | Anderson | |
| 2011/0134640 | A1 | 6/2011 | Bertele | |
| 2012/0298813 | A1 | 11/2012 | Gibbons et al. | |
| 2013/0333197 | A1 | 12/2013 | Schulte et al. | |
| 2015/0144760 | A1 | 5/2015 | Paradiso | |
| 2015/0308631 | A1 | 10/2015 | Gorman et al. | |
| 2017/0023186 | A1 | 1/2017 | Norton et al. | |
| 2019/0293269 | A1 | 9/2019 | Roys et al. | |
| 2019/0309933 | A1 | 10/2019 | Norton et al. | |

OTHER PUBLICATIONS

U.S. Appl. No. 29/642,843, filed Apr. 2, 2018, Curtis Alan Roys.
U.S. Appl. No. 29/657,390, filed Jul. 20, 2018, Curtis Alan Roys.

* cited by examiner

SYSTEM AND METHOD FOR MOUNTING LED LIGHT MODULES

RELATED APPLICATIONS

This application is a continuation of U.S. patent application Ser. No. 16/366,888, filed Mar. 27, 2019, which is a continuation-in-part application of U.S. patent application Ser. No. 16,282,039, filed Feb. 21, 2019, which claims priority from U.S. Prov. Pat. App. No. 62/635,362, filed Feb. 26, 2018. U.S. patent application Ser. No. 16/366,888 is also a divisional application of U.S. patent application Ser. No. 29/657,390, filed Jul. 20, 2018, and a divisional application of U.S. patent application Ser. No 29/639,296, filed Mar. 5, 2018, all of which are hereby incorporated by reference.

TECHNICAL FIELD

The present invention relates to a system for supporting light-emitting diode (LED) light modules.

BACKGROUND

Common lighting includes incandescent lights, fluorescent lights and light-emitting diodes (LEDs). Incandescent lights operate by flowing electricity through a filament inside a glass bulb. The filament heats up and glows, creating light. However, this technology creates a lot of heat. An incandescent light bulb loses 98% of its energy producing heat, making it quite inefficient. On Jan. 1, 2014, in keeping with a law passed by Congress in 2007, 40- and 60-watt incandescent light bulbs could no longer be manufactured in the U.S., because they failed to meet federal energy-efficiency standards. This policy was the final step in a gradual phase-out beginning in 2012 with 100-watt bulbs, then progressing to discontinuation of the 75-watt variety.

Fluorescent lights are low pressure mercury-vapor gas-discharge lamps that use fluorescence to produce visible light. An electric current in the gas excites mercury vapor which produces short-wave ultraviolet light that then causes a light-emitting phosphor coating on the inside of the bulb to glow. Fluorescent lights are used as back lighting for signs and are also found in residences, such as in kitchens, basements, or garages, in schools and in businesses because the cost savings when using fluorescent lamps tend to be significant when compared to the cost of incandescent light use. Disposal and accidental breakage of fluorescent bulbs, which contain toxic mercury, can result in potentially dangerous chemical contamination.

The fastest-developing lighting technology today is the light-emitting diode (LED). Recent developments in LED technology have made LEDs more efficient and cheaper to use than both fluorescent bulbs and incandescent bulbs. A type of solid-state lighting, LEDs use a semiconductor to convert electricity directly into light, are often small in area (less than 1 square millimeter) and may emit light in a specific direction, reducing the need for reflectors and diffusers that can trap light. LEDs are also the most efficient lighting technology on the market. A light bulb's efficiency (also called luminous efficacy) is a measure of emitted light (lumens, lm) divided by power drawn (watts, W). A bulb that is 100 percent efficient at converting energy into light would have a luminous efficacy of 683 lm/W. To put this in context, a 60- to 100-watt incandescent bulb has a luminous efficacy of 15 lm/W, an equivalent compact fluorescent lamp (CFL) has a luminous efficacy of 73 lm/W, and current LED-based replacement bulbs on the market range from 70 to 120 lm/W with an average luminous efficacy of 85 lm/W.

LED light modules and strip lighting have been in existence for several years. A current trend is to retrofit incandescent and fluorescent lighting with energy and environmentally-friendly LED technology. Such a system is described, for example, in U.S. Pat. Pub. No. 2017/0023186 for "Method and Assembly for Replacing Fluorescent Lights". In a retrofit replacement for a fluorescent light, typically one or more LED light modules are typically mounted onto a support, such as an aluminum tube, and support bases, such as end caps, configured to fit into the fluorescent light sockets are installed on or near the ends of the support. Power is provided to the LED light modules from a power supply through one or more of the end caps or through a wire that runs from the power supply to the LED light modules without going through the end caps.

LED light modules are typically manufactured having double-sided adhesive tape on the backside for mounting the LED light module onto the surface of a support and/or having holes for screws to mount the LED light module onto the support. The double-sided adhesive tape requires a clean surface to adhere to. The square aluminum stock tubes from which the supports are made in a sign shop have on their surfaces an oily residue, which can cause the adhesive on the tape to fail to hold the LED light module to the aluminum tubing, particularly when temperatures rise in a sign cabinet. Oil films continue to persist even after cleaning. The adhesive loses adhesion due to the heat and oily surface and the LED light modules may fall off the aluminum tubing. This problem dictates the additional use of adhesives (silicone/glue and/or fasteners (screws) to securely hold each LED light module in place, which requires drilling screw holes at the desired positions in the support and is time consuming.

Thus, it would be beneficial to enable easier, faster and more convenient mounting of LED light modules which does not require either adhesives or screws to obtain the advantages of high luminous efficacy LED lighting in place of older, less efficient lighting methods.

SUMMARY

An object of the invention is to provide a method and system for supporting LEDs.

An LED support clip includes a support element clamp for clamping onto a support element and at least one LED light module clamp for clamping an LED light module onto the LED support clip, thereby attaching the LED module to the support element without requiring the use of adhesives or threaded connectors.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION

Figure 1:
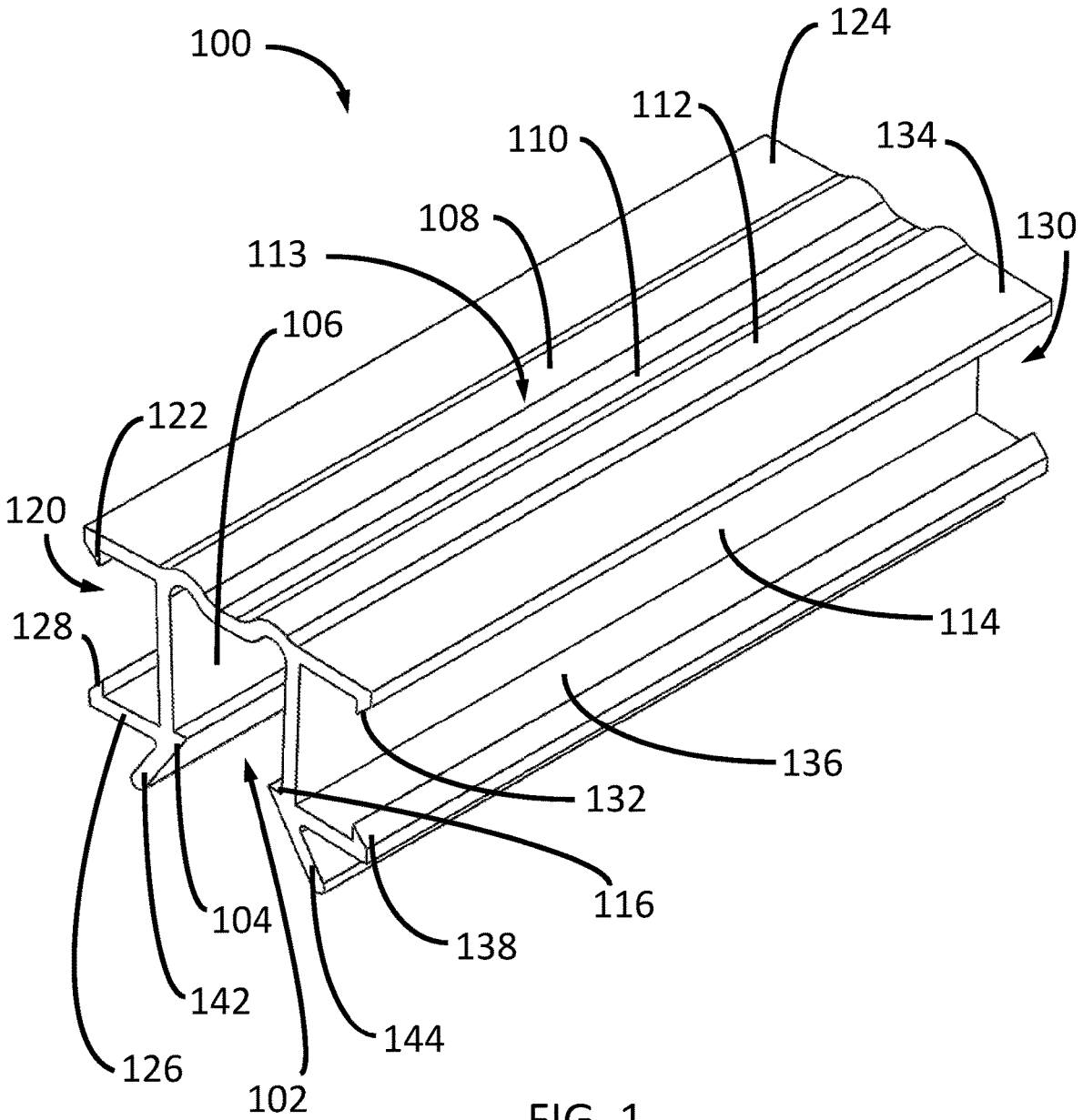
FIG. 1 is an isometric view of an LED support clip.

LED support clips are disclosed which are operable to enable simple Snap-On attachment of any LED light module to support elements, such as tubular mounting hardware ("tubing"). In embodiments, the LED support clip holds itself firmly on a support element by a clamp comprising spring tension jaws. One or more LED light modules may then be held firmly within the LED support clip by additional clamps also comprising spring tension jaws. For the various jaws, the springiness is typically designed into the jaws and occurs as a result of the jaw design and manufacturing. "Spring tension", "springiness", and similar terms as used herein do not imply the use of a separate spring element, but may result from the inherent springiness of the material from which the LED support clip is fabricated.

Since both attachment of the LED light assemblies to the LED support clip and the attachment of the LED support clip to the support do not utilize adhesives or screws, the LED support clip can thus be readily removed, for example, to replace a faulty LED light module. The LED support clip may also be positioned and/or repositioned at any position along the support to locate the LED light module where required. The LED support clip is preferably made from any material that is sufficiently elastic such that the LED support clip will clamp onto a support with sufficient force to be immobile during use. The material of the LED support clip is preferably also sufficiently flexible, and the spring tension not so great, so that that the LED support clip can subsequently be removed or repositioned as required at a later time. Suitable materials for fabrication of the LED support clip may include plastics or other polymers, including thermoplastics, such as acrylonitrile butadiene styrene (ABS) and elastomers. In some embodiments, the LED support clip is made from ABS and has wall thickness is 0.060 or 0.070 inches, which is sufficiently thick to clamp onto the support while sufficiently springy to allow for removal in order to reposition or replace an LED mount. In some embodiments, a relief radius is formed in the interior corner between each jaw and the top portions that the LED support element will fit within the LED mount without interference. A LED support clip may also be made of metal or other material. Whatever material is chosen, the wall thicknesses of the jaws in the clamps is selected to provide a balance between clamping force and ease of mounting and removing. The clamping force is sufficient to keep the LED clip 100 attached to a support element without the LED clip 100 sliding along the support element or detaching during normal operation.

In some embodiments, the jaws of the clamps may have a "toe-in" angle, i.e., the jaws may be angled slightly towards each other toward their distal ends. That is, the distance between the interior surface of the first support element jaw and the interior surface of the second support jaw is larger at the jaw mounting portion than at the distal end of the first support element jaw and the second support jaw. The "tow-in" angle is preferably less than 20 degrees on each jaw. When the jaws are described as "substantially parallel" or "substantially perpendicular to the jaw mounting portion," substantially as used herein allows for a toe-in angle. The frictional force between the LED support clip and the support may be determined, therefore, by the material properties, such as the Young's modulus, of the LED support clip, the wall thickness, and the toe-in angle. The frictional force between the LED support clip and the support may also be affected by the material from which the support is made. Various mechanical geometries of the LED support clip will also affect the ease of mounting and removal of the LED support clip, as well as how well the LED support clip adheres to the support. For example, protrusions, such as hook-like projections or bumps, at the end of the jaws may trap the support between the jaws. Angled surfaces (leads) at the end of the jaws may facilitate momentarily springing the jaws apart as the LED support clip is pushed onto the support.

Some embodiments may employ a biasing device, such as a spring, to hold the jaws closed, rather than using the natural springiness of the LED support clip material. The LED support clip can be manufactured to conform to support elements having any cross-sectional shape, for example, square, triangular, rectangular, pentagonal, hexagonal, "I"-shaped, "L"-shaped, and round.

LED Support clip

Figure 2:
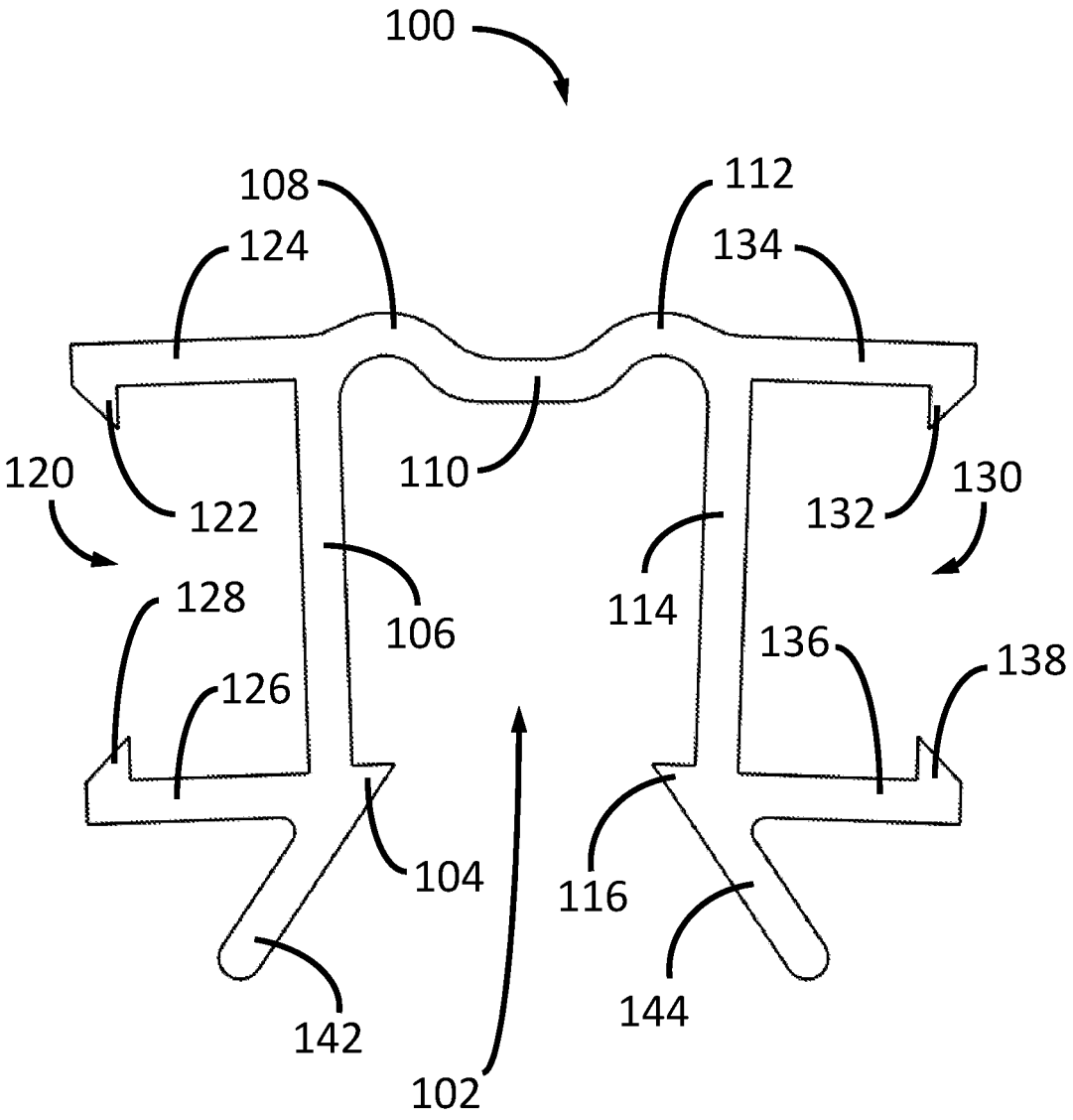
FIG. 2 is an end view of the LED support clip in FIG. 1.
Figure 3:
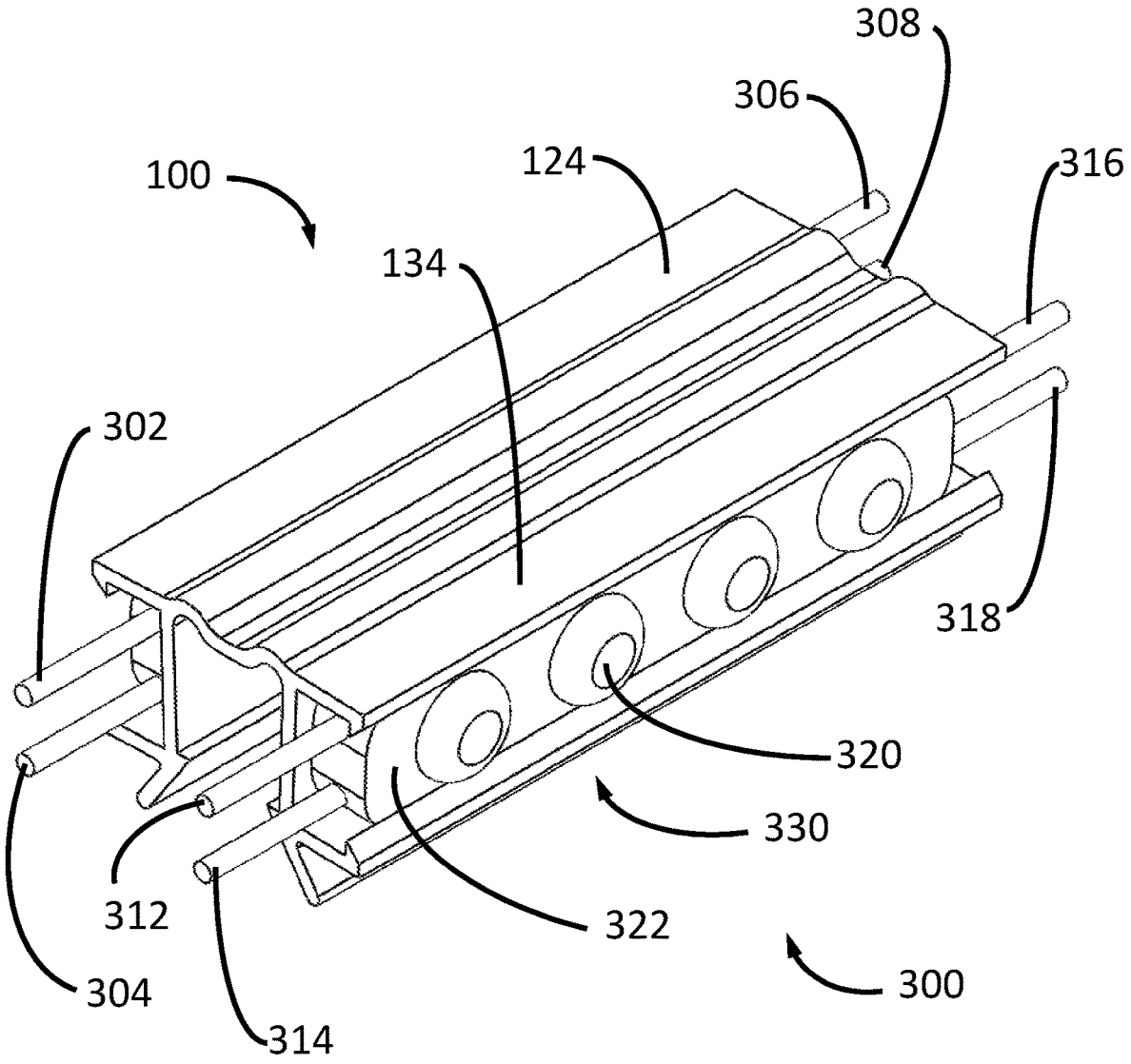
FIG. 3 is an isometric view of an LED light assembly comprising an LED support clip and multiple LED light modules.
Figure 4:
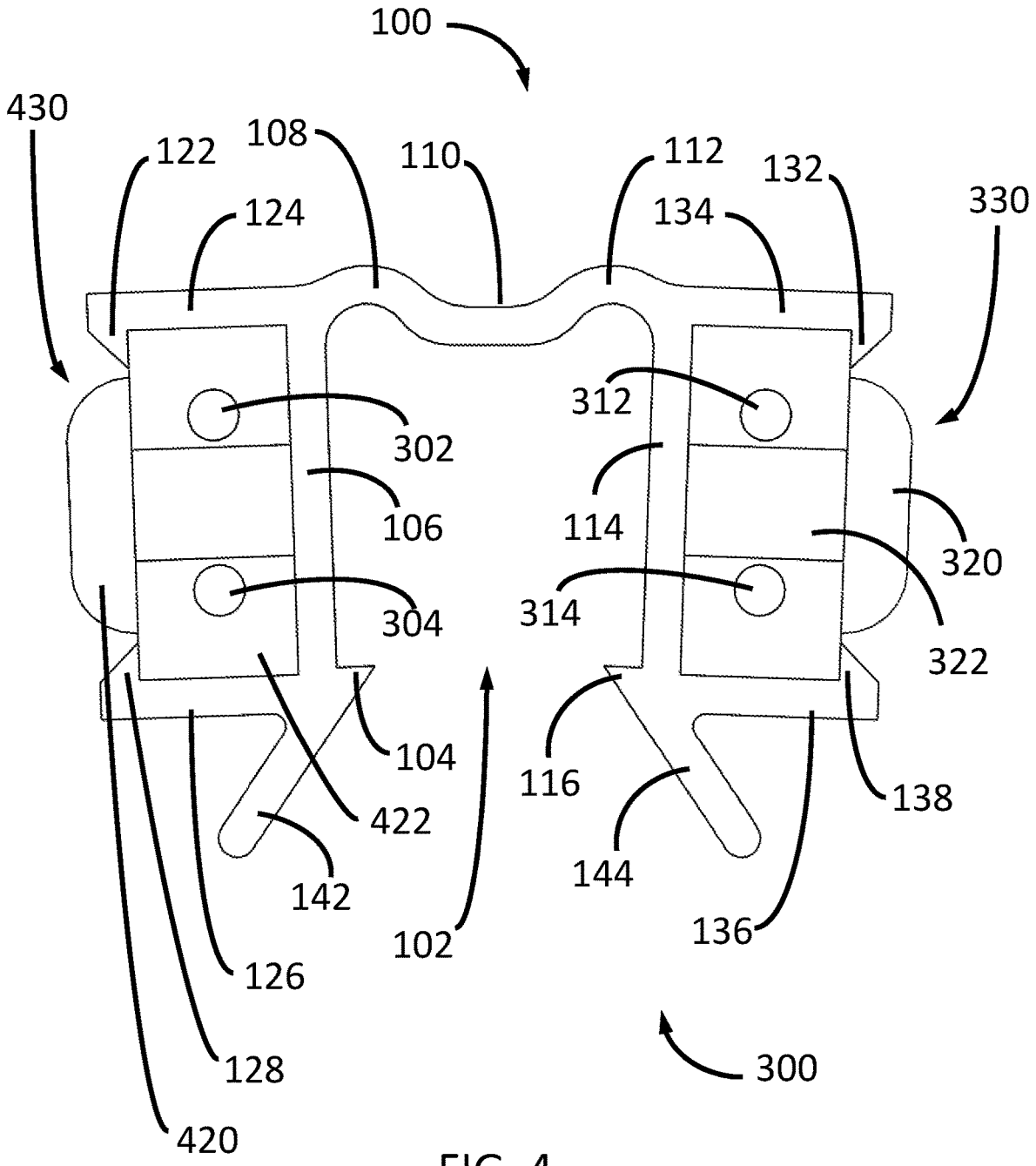
FIG. 4 is an end view of the LED light assembly in FIG. 3.
Figure 5:
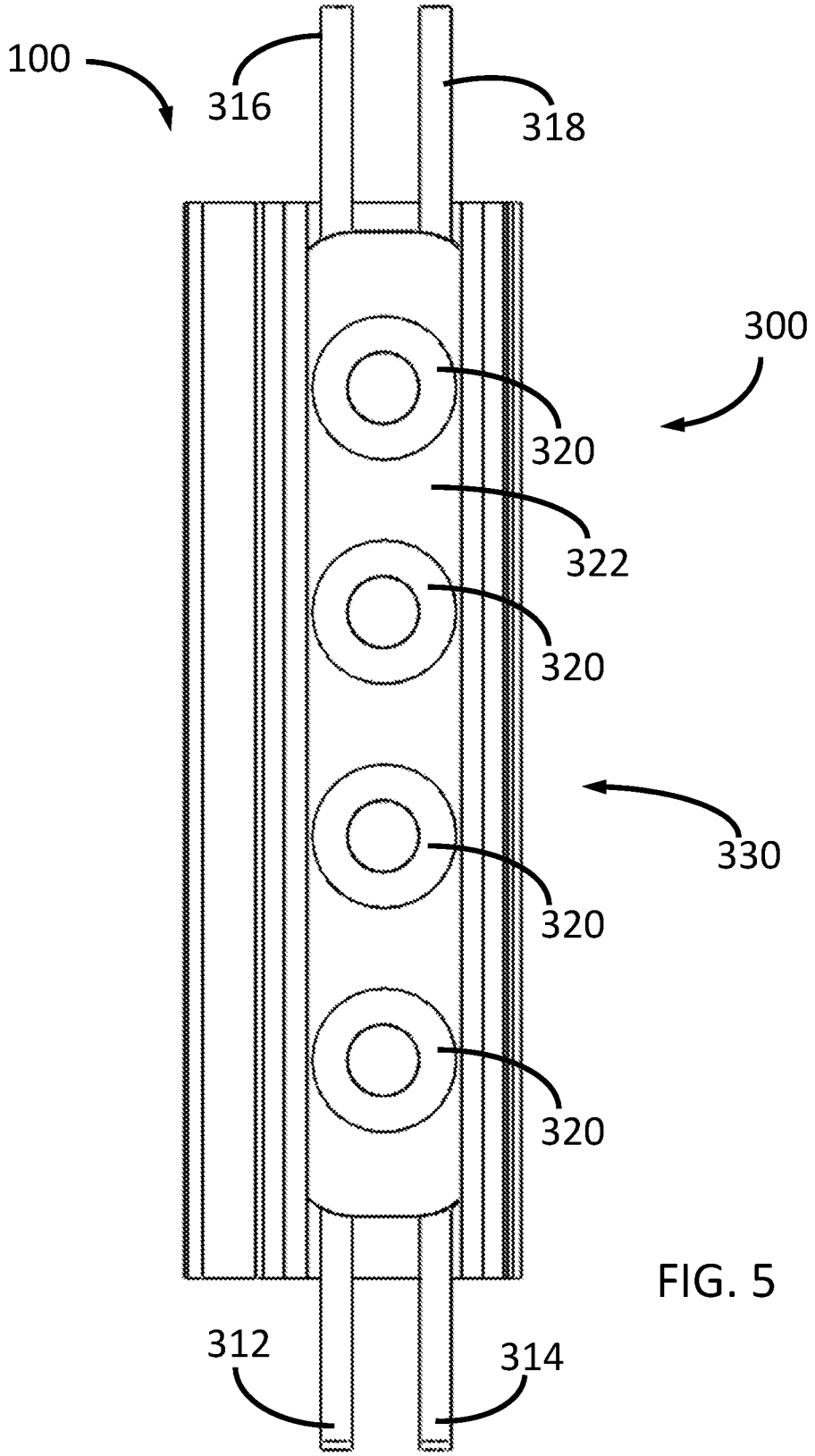
FIG. 5 is a side view of the LED light assembly in FIG. 3.
Figure 6:
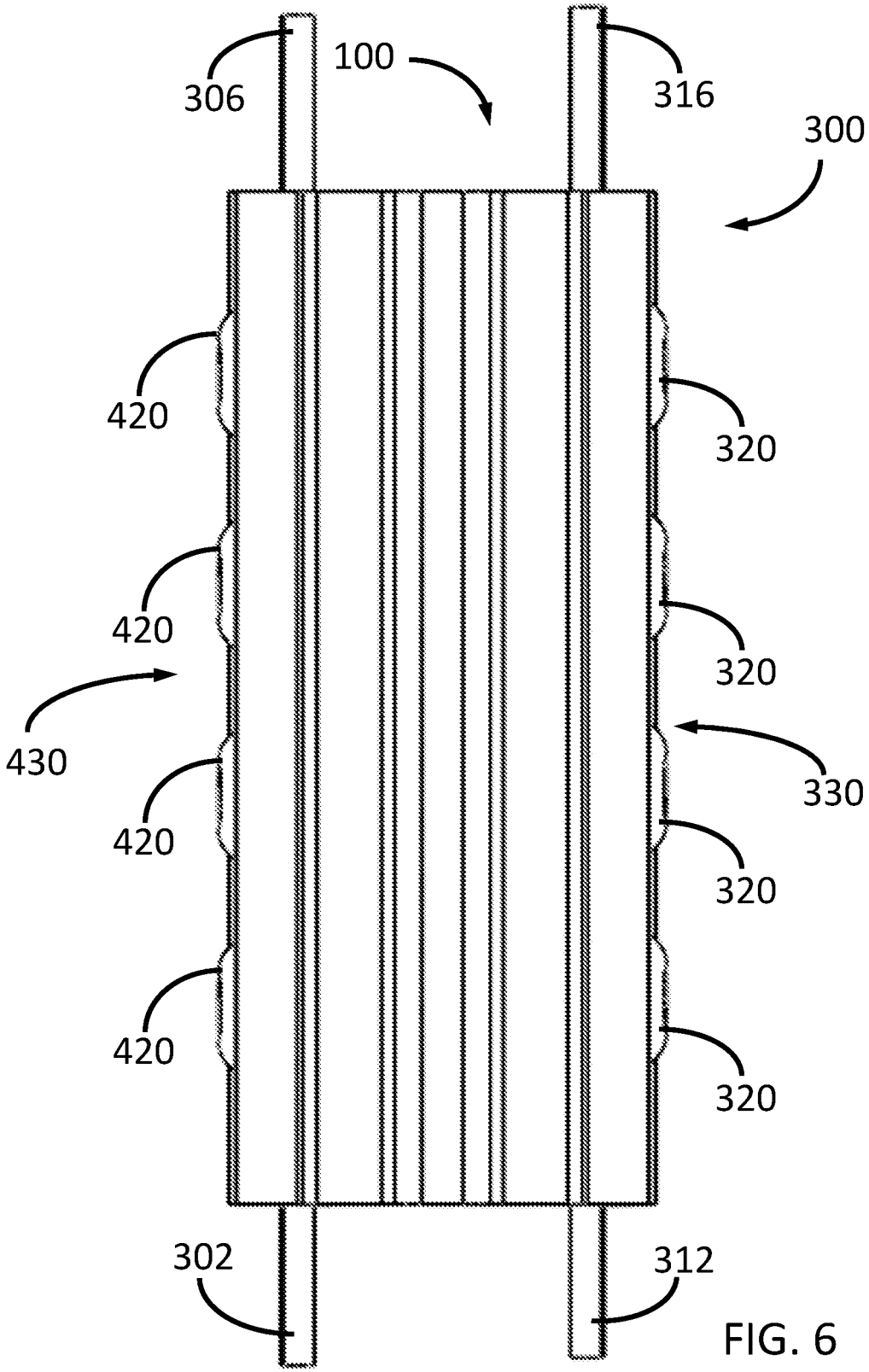
FIG. 6 is a top view of the LED light assembly in FIG. 3.
Figure 11:
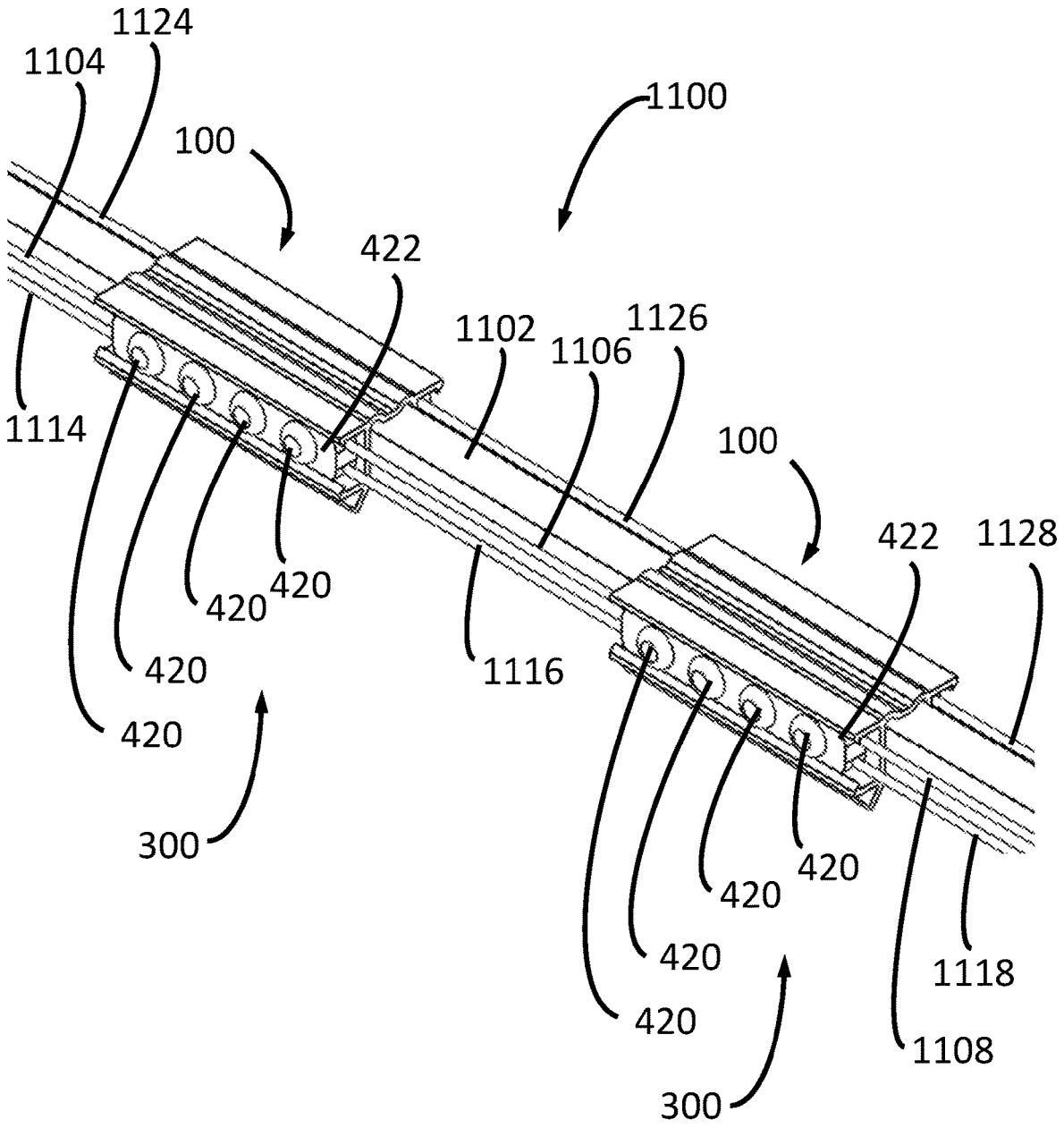
FIG. 11 is an isometric view of an LED light stick.
Figure 12:
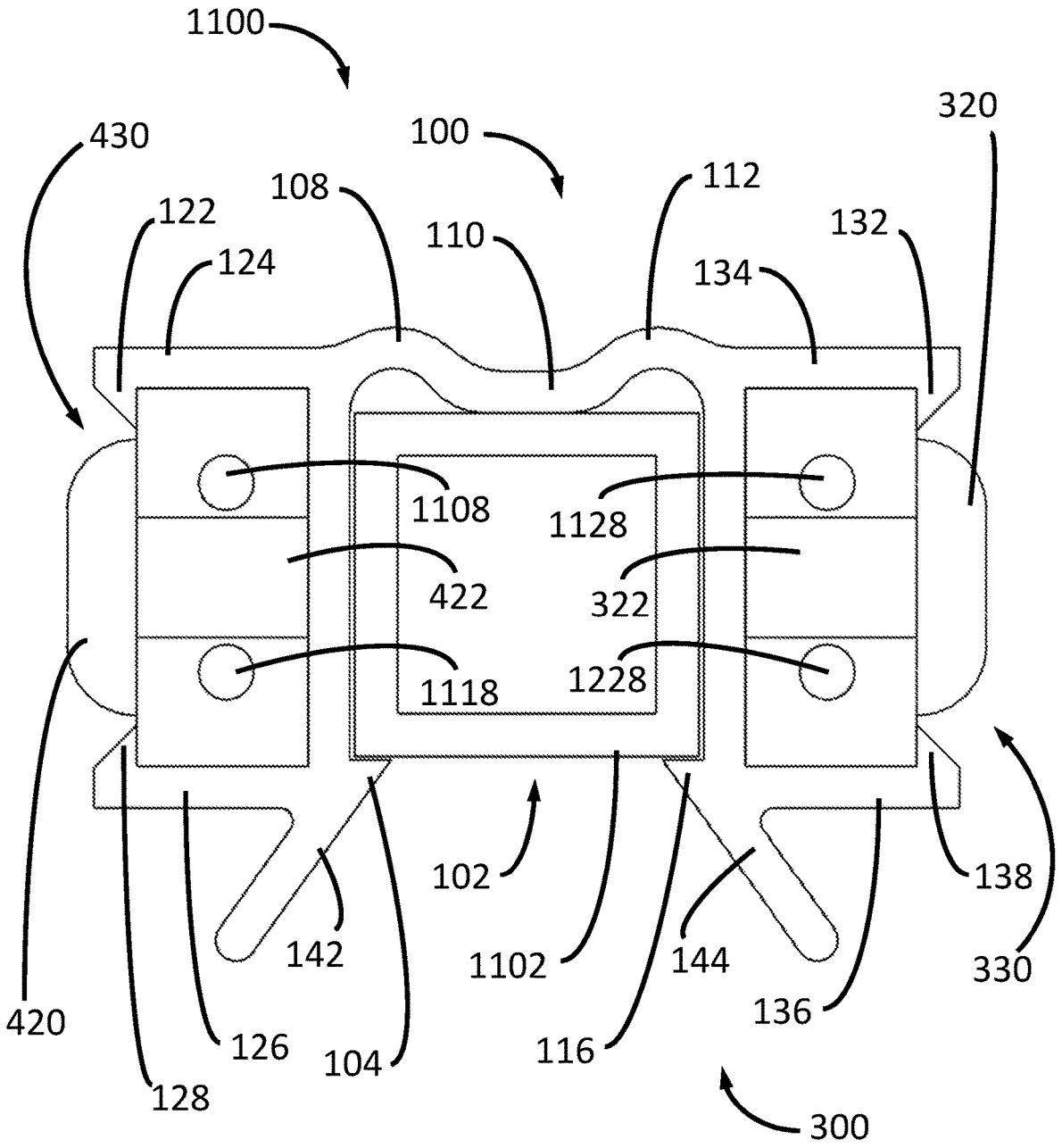
FIG. 12 is an end view of the LED light stick in FIG. 11.

FIGS. 1-2 illustrate an LED support clip 100. Two LED light module clamps 120 and 130 at the left and right sides of FIG. 2, respectively, are operable to each hold an LED light module, such as LED light modules 330 and 430 as illustrated in FIGS. 3-7. A support element clamp 102 is operable for attaching the LED support clip to a support element, such as support element 1102 as illustrated in FIGS. 11-12.

Support element clamp 102 comprises two support element support element jaws 106 and 114, which are connected together by curved spring elements 108 and 112, connected together by straight section 110, wherein spring elements 108 and 112 and straight section 110 comprise a jaw mounting portion 113. In some embodiments, jaw mounting portion 113 may comprise only a straight section 110. Spring elements 108 and 112 provide a relief, that is, a gap that prevents interference of the corners of the support element with the LED clip 100. A protrusion or projection at the distal ends of support element jaws 106 and 114 tend to retain the support element within the support element clamp 102. For example, in the embodiment shown, hook/lead 104 is positioned at a distal end of jaw 106 and hook/lead 116 at a distal end of jaw 114 are operable to capture a support element such as support element 1102 as illustrated in FIGS. 11-12. Hook/leads 104 and 116 also may function in conjunction with a first angled tab 142 extending from the first support element jaw 106 and a second angled tab 144 extending from the second support element jaw 114, each of the first and second angled tabs 142 and 144 extending in a direction away from the center of the opening of clamp 102 between the first support element jaw 106 and the second support element jaw 114, the angled tabs configured to spread the jaws and guide a support element into the opening. Angled tabs 142 and 144 to facilitate insertion of a support element 702 into clamp 102 during mounting of the LED light assembly 300 onto the support element 1102 as illustrated in FIGS. 13-16. FIG. 2 shows that hook/leads 104 and 116 each includes an upper surface that is substantially perpendicular to support element jaws 106 and 114 to retain a support element, and a lower surface that is the angled with respect to support element jaws 106 and 114 to facilitate insertion of the support element.

LED light module clamp 120 comprises two LED module clamping jaws 124 and 126, which are interconnected by jaw 106. Hook/lead 122 at a distal end of LED module clamping jaw 124 and hook/lead 128 at a distal end of jaw 126 are operable to capture an LED light module, such as LED light module 430 in FIG. 4, and outer angled surfaces of hook/leads 122 and 128 may be operable as leads to facilitate insertion of the LED light module 430.

LED light module clamp 130 comprises two LED module clamping jaws 134 and 136, which are interconnected by jaw 114. Hook/lead 132 at a distal end of LED module clamping jaw 134 and hook/lead 138 at a distal end of jaw 136 are operable to capture an LED light module, such as LED light module 330 in FIG. 4, and outer angled surfaces of hook/leads 132 and 138 may be operable as leads to facilitate insertion of the LED light module 430.

Other embodiments of an LED clip can one or more LED light module clamps positioned in any combination of left side, right side, or above, that is, on the jaw mounting portion of clip 100.

Clamping of LED Light Modules in the LED Support Clip to Form an LED Light Assembly FIGS. 3-6 show views of an LED light assembly 300 comprising an LED support clip 100 which is clamping two LED light modules 330 and 430. In embodiments, LED support clip 100 may be operable to clamp one, two, or more LED light modules.

LED light module 330 comprises an LED mount 322 with multiple LEDs 320 attached. A first pair of wires 312 and 314 may extend from one end of LED light module 330 and a second pair of wires 316 and 318 may extend from an opposite end of LED light module 330. In some embodiments, wires 312 and 316 may correspond to a single first wire and wires 314 and 318 may correspond to single second wire. In some embodiments LEDs 320 may be connected in parallel between the first and second wires. In some embodiments, LEDs 320 may be connected in series, or in a combination of parallel and series connections.

LED light module 430 comprises an LED mount 422 with multiple LEDs 420 attached. A third pair of wires 302 and 304 may extend from one end of LED light module 430 and a fourth pair of wires 306 and 308 may extend from an opposite end of LED light module 430. In some embodiments, wires 302 and 306 may correspond to a single third wire and wires 314 and 318 may correspond to single fourth wire. In some embodiments LEDs 420 may be connected in parallel between the third and fourth wires. In some embodiments, LEDs 420 may be connected in series, or in a combination of parallel and series connections.

Any of the structures described with respect to support element clamp 102 can be applied to LED light module clamps 120 and 130. For example, LED light module clamps 120 and 130 can include angled tabs similar to angled tabs 142 and 144 and spring portions similar to spring elements 108 and 112.

LED modules come in various sizes and shapes. The design of light module clamps 120 and 130 and any other light module clamps will vary with the size and shape of the LED module being clamped in any particular embodiment. Similarly, the size and shape of support element clamp 102 will vary with the size and shape of the support element in any particular embodiment. The LED support clips shown in the figures are merely examples of one embodiment of an LED support clip.

Method of Forming an LED Light Assembly

Figure 7:
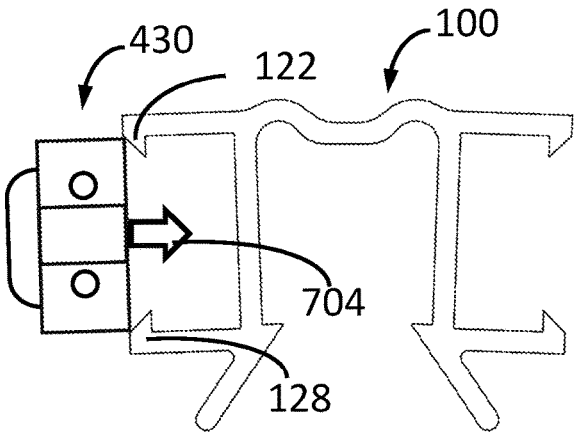
FIG. 7 is a first step in a method for constructing an LED light assembly.

FIGS. 7-10 show four steps in a method for constructing an LED light assembly 300. In FIG. 7 arrow 704 represents relative motion between the LED light module 430 and the LED support clip 100 wherein this relative motion brings the right two edges of LED light module 430 into contact with hook/leads 122 and 128 on LED support clip 100. There may be a small "toe-in" angle (not shown) between LED module clamping jaws 124 and 126—as LED module clamping jaws 124 and 126 are spread apart in FIGS. 8-10 this initial "toe-in" angle may change to a positive "toe-out" angle (or a 0° angle in FIG. 10) thereby generating a clamping force between LED module clamping jaws 124 and 126 and the LED light module 430.

Figure 8:
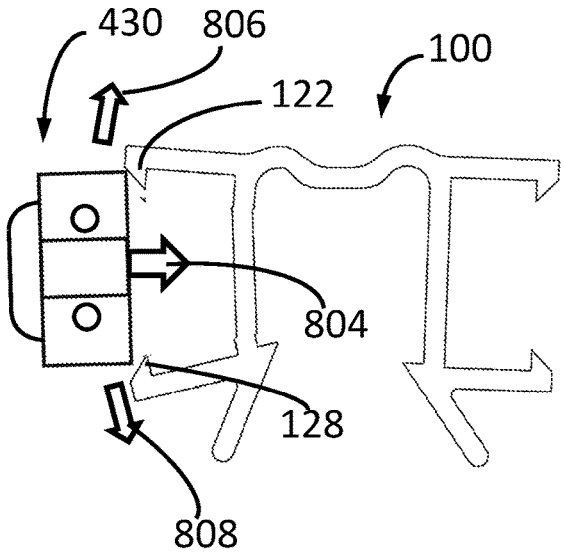
FIG. 8 is a second step in a method for constructing an LED light assembly.

In FIG. 8, LED light module 430 has moved to the right as shown by arrow 804, thereby causing the two right edges of LED light module 430 to slide along hook/leads 122 and 124, forcing LED module clamping jaws 124 and 126 apart as shown by arrows 806 and 808 and changing the relative angle between LED module clamping jaws 124 and 126 to a small positive "toe-out" angle as shown.

Figure 9:
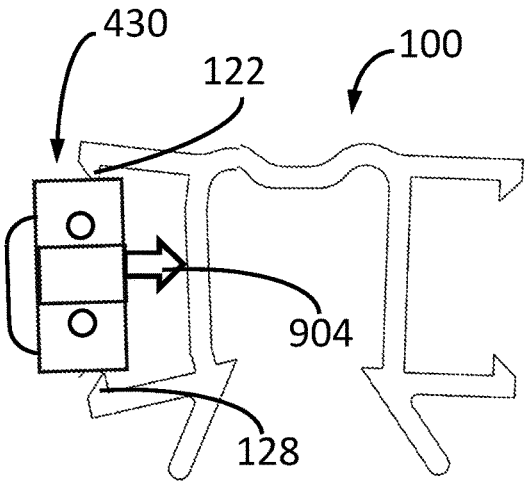
FIG. 9 is a third step in a method for constructing an LED light assembly.
Figure 10:
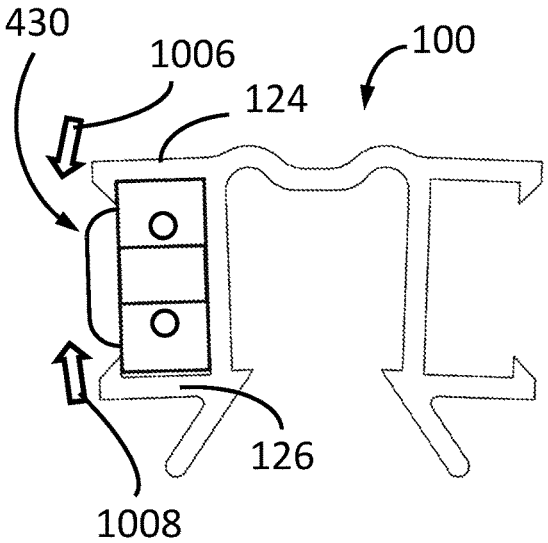
FIG. 10 is a fourth step in a method for constructing an LED light assembly.

In FIG. 9, the LED light module 430 is sliding along the edges of hook/leads 122 and 128 as shown by arrow 904. There is no further spreading of LED module clamping jaws 124 and 126 at this point. Finally, in FIG. 10, the LED light module 430 is fully moved rightwards into the LED support clip 100, allowing LED module clamping jaws 124 and 126 to snap-back as shown by arrows 1006 and 1008. The angle between LED module clamping jaws 124 and 126 will typically be about 0° in this configuration (i.e., LED module clamping jaws 124 and 126 are approximately parallel, clamping the LED light module 430 along a substantial portion of the lengths of LED module clamping jaws 124 and 126). Hook/leads 122 and 128 may be configured with lengths in the vertical direction (i.e., parallel to the left side of the LED light module 430) sufficiently long to extend out past radii at the left edges of the left side of LED light module 430, thereby enabling hook/leads 122 and 128 to exert rightward retaining forces on the LED light module 430 to securely retain the LED light module 430 within the LED support clip 100. The spring force derived from the difference between initial "toe-in" angle in FIG. 7 and the final angle in FIG. 10, combined with the coefficients of friction of the inner surfaces of LED module clamping jaws 124 and 126 and the coefficients of friction of the upper and lower sides of LED light module 430, generates a clamping and retaining force between the LED light module 430 and the LED support clip 100.

LED Light Stick

FIGS. 11-12 show views of an LED light stick 1100 comprising two LED light assemblies 300 mounted onto the support element 1102. Wires 1104, 1106, 1108 may correspond to a single wire in embodiments. Wires 1114, 1116, 1118 may correspond to a single wire in embodiments. Wires 1124, 1126, 1128 may correspond to a single wire in embodiments. Wires 1104-1128 may correspond to any of wires 302-318 in FIGS. 3-6.

Method of Forming an LED Light Stick

Figure 13:
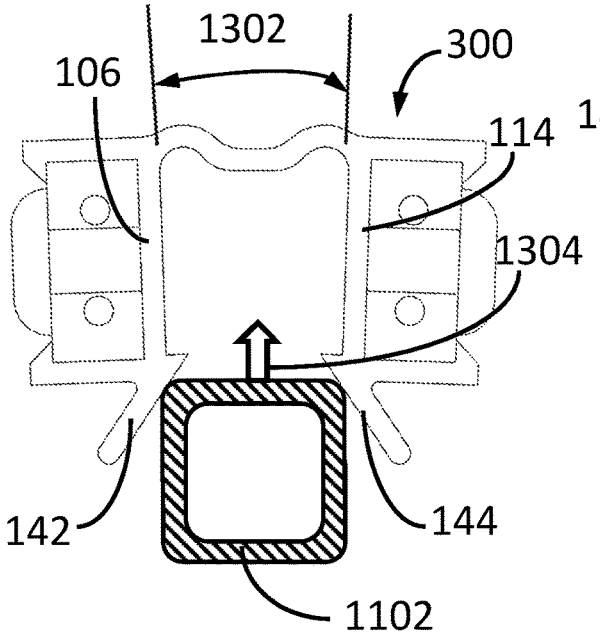
FIG. 13 is a first step in a method for constructing an LED light stick.

FIGS. 13-16 show four steps in a method for constructing an LED light stick. In FIG. 13, arrow 1304 represents relative motion between the LED light assembly 300 and the support element 1102 wherein this relative motion brings the upper two edges of support element 1102 into contact with tabs 142 and 144 on LED light assembly 300. Angle 1302 represents a small "toe-in" angle between support element jaws 106 and 114—as support element jaws 106 and 114 are spread apart in FIGS. 14-16 this initial angle 1302 changes to a positive "toe-out" angle (see angles 1402-1602) thereby generating a clamping force between support element jaws 106 and 114 and the support element 1102.

Figure 14:
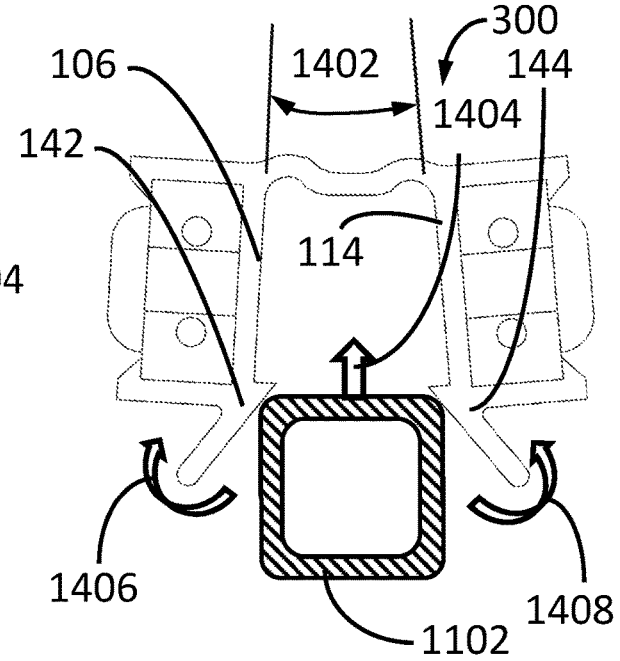
FIG. 14 is a second step in a method for constructing an LED light stick.

In FIG. 14, the support element 1102 has moved upwards as shown by arrow 1404, thereby causing the two upper edges of support element 1102 to slide along tabs 142 and 144 and hook/leads 104 and 116, forcing support element jaws 106 and 114 apart as shown by arrows 1406 and 1508 and changing the relative angle between support element jaws 106 and 114 from a small negative "toe-in" angle to a small positive "toe-out" angle 1402 as shown.

Figure 15:
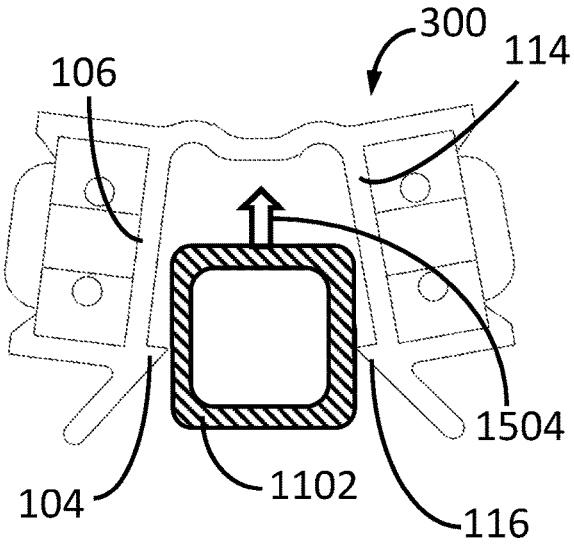
FIG. 15 is a third step in a method for constructing an LED light stick.
Figure 16:
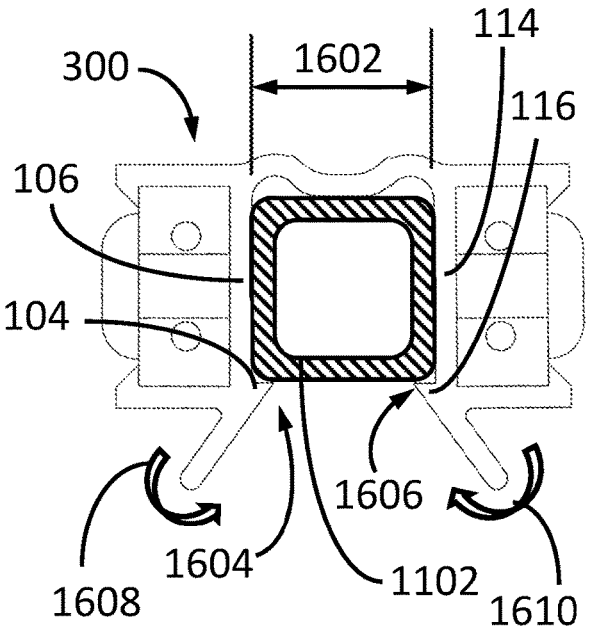
FIG. 16 is a fourth step in a method for constructing an LED light stick.

In FIG. 15, the support element 1102 is sliding along the edges of hook/leads 104 and 116 as shown by arrow 1504. There is no further spreading of support element jaws 106 and 114 at this point. Finally, in FIG. 16, the support element 1102 is fully moved upwards into the LED light assembly 300, allowing support element jaws 106 and 114 to snap-back as shown by arrows 1608 and 1610. The angle 1602 between support element jaws 106 and 114 will typically be about 0° in this configuration (i.e., support element jaws 106 and 114 are approximately parallel, clamping the support element 1102 along a substantial portion of the lengths of support element jaws 106 and 114. Hook/leads 104 and 116 may be configured with lengths in the horizontal direction (i.e., parallel to the lower edge of the support element 1102) sufficiently long to extend out past radii at the lower edges of the support element 1102, thereby enabling hook/leads 104 and 116 to exert upward retaining forces on the support element 1102 to securely retain the support element 1102 within the LED light assembly 300. The spring force derived from the difference between initial "toe-in" angle 1302 and the final angle 1602, coupled with the coefficients of friction of the inner surfaces of support element jaws 106 and 114 and the coefficients of friction of the left and right outer walls of the support element 1102 combine to generate a clamping and retaining force between the LED light assembly 300 and the support element 1102.

OTHER EMBODIMENTS

In the embodiments shown, the support element was illustrated with a square cross-sectional shape with jaws shaped correspondingly. Other cross-sectional support element shapes fall within the scope of the invention, including: square, triangular, rectangular, pentagonal, hexagonal, "I"-shaped, "L"-shaped, and round. Jaws may be designed within the scope of the invention to provide secure mounting to these various support element shapes.

Embodiments may provide clamping to horizontal, vertical or both horizontal and vertical support elements. Embodiments may provide clamping to support elements in various spatial orientations.

In the LED support clip, the jaws of the LED light module clamps may be designed to accommodate clamping of various sizes and shapes of LED light modules. In the LED support clip, the jaws of the support element clamp may be designed to accommodate clamping of various sizes and shapes of support elements.

Flowchart for a Method of Constructing LED Light Sticks

Figure 17:
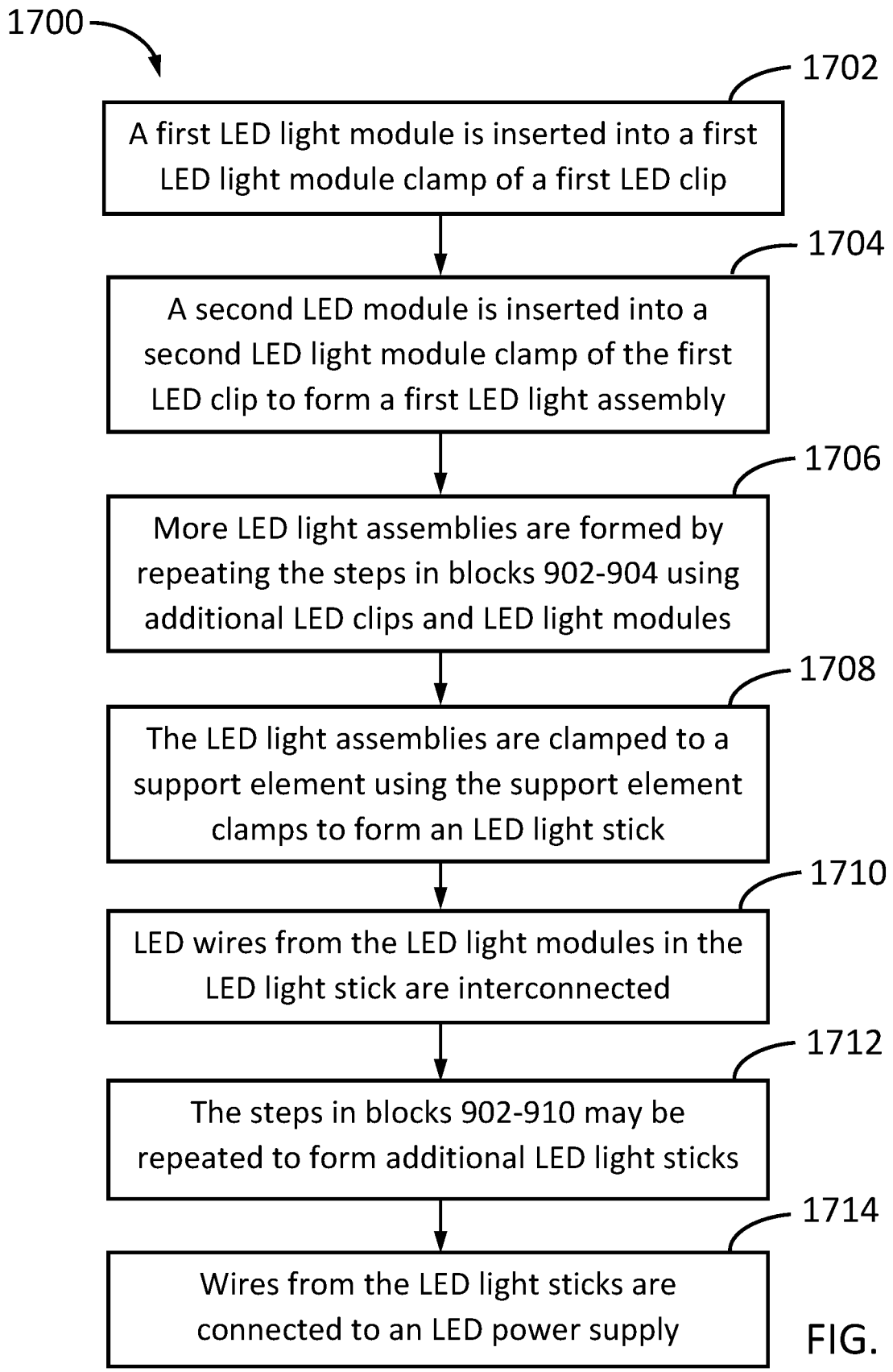
FIG. 17 is a flowchart for construction of LED light sticks.

FIG. 17 is a flowchart 1300 for construction of the LED light assemblies 300 of FIGS. 3-6 and mounting the LED light assemblies 300 on a support element 1102 as shown in FIGS. 11-12 to form the LED light stick 1100.

In block 1702, a first LED light module is inserted to a first LED light module clamp of a first LED support clip.

In block 1704, a second LED light module is inserted into a second LED light module clamp if the first LED support clip, thereby forming a first LED light assembly as in FIGS. 3-6.

In block 1706, the procedure in blocks 1702 and 1704 may be repeated to form additional LED light assemblies as in FIGS. 3-6.

In block 1708, the LED light assemblies formed in blocks 1702-1706 are clamped to the support element using the support element clamps in each LED support clip to form the LED light stick.

In block 1710, the wires from the LED light modules are interconnected.

In block 1712, the steps in blocks 1702-1710 may be repeated to form additional LED light sticks.

In Block 1714, the wires from the LED light sticks are connected to an LED power supply.

While the foregoing describes a preferred embodiment of the present invention, one skilled in the art will appreciate that various changes, substitutions and alterations may be made without departing from the scope of the invention. Although the present invention and its advantages have been described in detail, it should be understood that various changes, substitutions and alterations may be made herein without departing from the scope of the invention as defined by the appended claims. LED modules can be attached on any surface of the support element, and on multiple surfaces of the support element to provide light output in different directions. Either a single LED support clip or multiple LED support clips may be attached to a single support element. The support element may be of any length, where the length of the support element may vary with the implementation. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A light emitting diode (LED) support clip, comprising:

a support element clamp, operable to clamp the LED support clip to a support element, the support element clamp comprising;

a jaw mounting portion having a long axis;

a first support element jaw, the first support element jaw extending in a first direction at approximately a right angle to the jaw mounting portion, and a second support element jaw, the second support element jaw extending in the first direction at approximately a right angle to the jaw mounting portion;

the first support element jaw and the second support element jaw configured to provide a clamping force onto a support element positioned between the first support element jaw and the second support element jaw; and at least one LED light module clamp, operable to clamp an LED light module to the LED support clip, the at least one first LED light module clamp comprising:

a first LED module clamping jaw; and a second LED module clamping jaw approximately parallel to the first LED clamping jaw, in which:

the LED support clip has an LED support clip length measured along the long axis;

the at least one LED light module clamp has an LED light module clamp width measured between the first LED clamping jaw and the second LED clamping jaw; and the LED support clip length is longer than the LED light module clamp width.

2. The LED support clip of claim 1 in which one or both of the first support element jaw and the second element support jaw includes a protrusion at the distal end to maintain the support element between the first support element jaw and the second element support jaw.

3. The LED support clip of claim 1 in which the distance between the interior surface of the first support element jaw and the interior surface of the second support jaw is larger at the jaw mounting portion than at the distal end of the first support element jaw and the second support jaw.

4. The LED support clip of claim 1 further comprising a first angled tab extending from the first support element jaw and a second angled tab extending from the second support element jaw, each of the first and second angled tabs extending in a direction away from the center of the opening between the first support element jaw and the second support element jaw, the angled tabs configured to spread the jaws and guide a support element into the opening.

5. The LED support clip of claim 1, in which each of the first LED module clamping jaw and the second LED module clamping jaw includes a distal end and in which one or both of the first LED module clamping jaw and the second LED module clamping jaw include a protrusion at the distal end.

6. The LED support clip of claim 1 in which the at least one LED light module clamp comprises at least two LED light module clamps.

7. The LED support clip of claim 6 in which two of the at least two LED light module clamps are positioned on opposite sides of the LED support clip.

8. The LED support clip of claim 1 in which the at least one LED light module clamp comprises an LED module clamp positioned opposite the opening between the first support element jaw and the second support element jaw.

9. The LED support clip of claim 1, wherein the support element clamp is operable to mount onto support elements having a cross-sectional shape selected from the group consisting of: square, triangular, rectangular, pentagonal, hexagonal, "I"-shaped, "L"-shaped, and round.

10. The LED support clip of claim 1, wherein the clamping of the LED support clip to the support element does not use adhesives or screws, and wherein the clamping of the LED light module to the LED support clip does not use adhesives or screws.

11. The LED Support clip of claim 1 in which the at least one LED light module clamp comprises a single LED light module clamp.

12. The LED Support clip of claim 1 in which the jaw mounting portion comprising at least one spring tension element.

13. The LED Support clip of claim 1 in which a cross section of the jaw mounting portion has a uniform thickness and includes two curved portions that are concave when viewed from an opening through which the support element is inserted between the first support element jaw and the second support element jaw.

14. An LED light stick, comprising:

a support element;

an LED support clip in accordance with claim 1.

15. The LED light stick of claim 14, the LED support clip further comprising a multiplicity of LED light module clamps.

16. A method for constructing an LED light stick, the method comprising:

constructing an LED light assembly by inserting an LED light module into an LED light module clamp in an LED support clip in accordance with claim 1, wherein the LED light module clamp is operable to clamp the LED light module between a pair of jaws without the use of adhesives or screws; and mounting the LED light assembly onto a support element using a support element clamp configured in the LED support clip, wherein the support element clamp is operable to clamp the support element between a pair of jaws without the use of adhesives or screws.

17. The method of claim 16, wherein:

in the support element clamp, the jaws have inward facing hooks on the distal edges of the jaws, the hooks being operable to retain the support element within the support element clamp; and in the LED light module clamp, the jaws have inward facing hooks on the distal edges of the jaws, the hooks being operable to retain the LED light module within the LED support clip.

18. The method of claim 16, further comprising interconnecting electrical wires from each LED light module; and connecting the interconnected electrical wires to an LED power supply.

19. The method of claim 16, the method further comprising constructing a multiplicity of LED light assemblies by inserting LED light modules into LED light module clamps in a multiplicity of LED support clips between pairs of jaws without the use of adhesives or screws; and mounting the LED light assemblies onto the support element using support element clamps configured in the LED support clips, wherein the support element clamps are operable to clamp the support elements between pairs of jaws without the use of adhesives or screws.

20. The method of claim 16 further comprising mounting the LED light stick in a sign cabinet.

* * * * *